United States Patent [19]

Salmon

[11] 4,237,579

[45] Dec. 9, 1980

[54] GRAINING BRUSH

[76] Inventor: Jonathan H. Salmon, 72 Trafalgar St., Belmore, New South Wales, 2192, Australia

[21] Appl. No.: 32,958

[22] Filed: Apr. 24, 1979

[30] Foreign Application Priority Data

Sep. 15, 1978 [AU] Australia ..... 39911/78

[51] Int. Cl.[3] ..... A47L 17/02

[52] U.S. Cl. ..... 15/166; 15/169; 15/177; 15/210.5; 15/246

[58] Field of Search ..... 15/166, 168, 169, 170, 15/171, 175, 177, 210.5, 246

[56] References Cited

U.S. PATENT DOCUMENTS

| | | | |
|---|---|---|---|
| 758,082 | 4/1904 | Lamb | 15/246 |
| 1,280,050 | 9/1918 | Lee | 15/168 X |
| 1,689,855 | 10/1928 | Breitenbach | 15/166 |
| 2,584,504 | 2/1952 | Seeber | 15/166 |

*Primary Examiner*—Christopher K. Moore

*Attorney, Agent, or Firm*—Stevens, Davis, Miller & Mosher

[57] ABSTRACT

A tool for applying a liquid stain to a flat surface to impart a timber grain effect comprising a paint brush, a bristle retaining slidable plate on one side of the brush and a slidable comb plate on the other side of the brush. Both the plates have an elongated slot which engages a bolt which passes through the paint brush. The comb adjustably separates the brush bristles into discrete bunches to permit the application of stain to impart a wood grain pattern.

8 Claims, 8 Drawing Figures

GRAINING BRUSH

Figure 1:
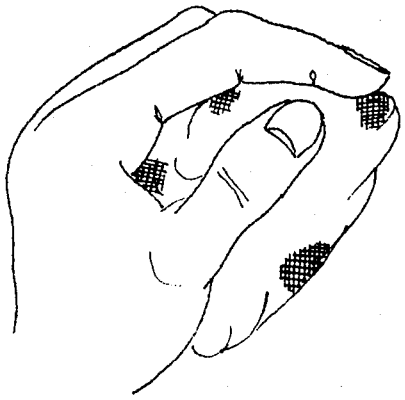
Fig. 1. PRIOR ART.

This invention relates to a method of imparting a timber grain effect to a flat or similar surface of furniture or the like, and more particularly to apparatus for simulating the grain of natural timber upon such a surface.

Attempts have been made to decorate or rejuvenate furniture using so-called graining processes wherein a suitable liquid stain is first deposited by spraying, pouring or the like upon a furniture panel, and then distributing that liquid in a manner intended to simulate the appearance of grain in a natural condition. One well known method of distributing such liquid has been the so-called rag or cloth system wherein a handful of muslin or similar cloth is manipulated across the surface to which said liquid has been applied.

However, this procedure has suffered from various disadvantages. For example, it has been found difficult when using such a rag to commence operation from a blank corner or edge of a panel, without a smudging effect and without in some cases removing fittings from the area to be processed. Thus, in a panel upon a cupboard or the like, small obstructions or features such as louvres would interrupt the movement of the rag and hence in order to achieve success with this relatively primitive method it was necessary to develop a technique requiring little less than a tradesman's skill.

Further attempts were made to abate the above disadvantages and in some cases an operator would apply gauze or similar open-meshed cloth over the ends of the bristles of a brush to encompass said bristles so that they were drawn into a series of bunches in the hope that such bunches could be applied to a surface to be treated, allowing lines to be drawn on a panel so as to distribute the stain in a manner simulating natural grain. However, this relatively crude procedure, even when washed with care by a prospective user, was not easy to copy with success, and even when partially successful it was found to be a time-consuming task. Moreover, this last-mentioned method, even when successfully executed, did not produce convincing results.

In a still further attempt to overcome the difficulties involved, a kind of cameo or intaglio font or mould, sometimes mounted upon a handle, and constructed from easily moulded materials such as rubber, somewhat in the manner of a rubber stamp, was formed with patterns somewhat resembling natural grain and the apparatus so formed was drawn or swirled across a stain-treated surface in the hope that a suitable grain pattern would emerge. However, this last-mentioned expedient, although it produced certain visual effects, did not produce any which could be said to resemble truly a natural wood grain, but rather certain freeform or surrealistic patterns, depending upon the nature of the grooves or swirls embedded in the surface of the tool itself.

It is an object of the present invention to overcome the above and other disadvantages and to provide a simple, effective grain-imparting tool capable of use successfully by a person such as an amateur, not necessarily possessing the skill of a tradesman, but who merely takes an elementary degree of care, whereby once a sufficient degree of technique is employed for the preparation of an applicator tool, only a minimum of technique is required to employ it to apply stain patterns to a surface. That is to say, the tool constructed in accordance with the invention can be used with eminent success by a child, or by any person capable of handling a conventional paint brush.

According to the invention therefore, in one of its aspects, a graining tool comprises in combination a paint brush, a bristle-retaining slidable plate having an elongated slot therein and a finger rest and pull-back lever thereon, a slidable comb plate terminating in a comb and having a second elongated slot therein together with a finger grip, said comb plate being adapted to slide within said bristle-retaining plate via fittingly co-acting respective margins of said plates, the latter being adapted to encompass the bristles of said brush in registering juxtaposition therewith, and lockably removable fastening means being adapted to engage said slots via a preformed hole in the bristle-supporting base of said brush, whereby said comb adjustably separates said brush bristles into discrete bunches to an extent determined by the relative endwise adjustment of said plates responsive to relative displacement of said finger grip with respect to said finger rest and pull-back lever, thereby permitting the application of said brush to a pre-stained surface to cause said bunches to impart a wood grain simulating pattern to said surface as said brush is manipulated across said surface with a pattern-describing motion.

Figure 2:
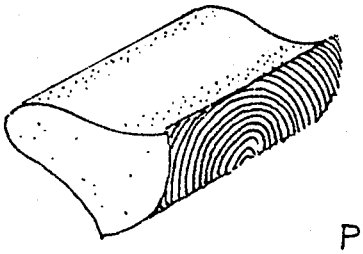
Fig. 2 PRIOR ART.
Figure 5:
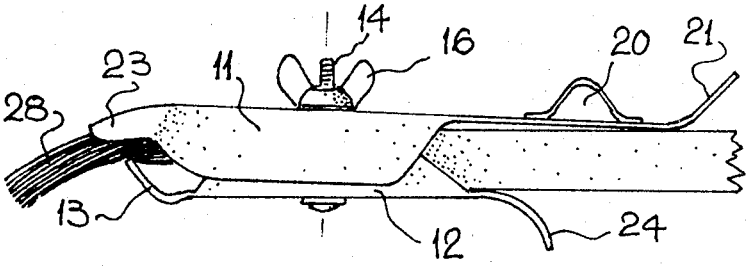
Figures 3, 4:
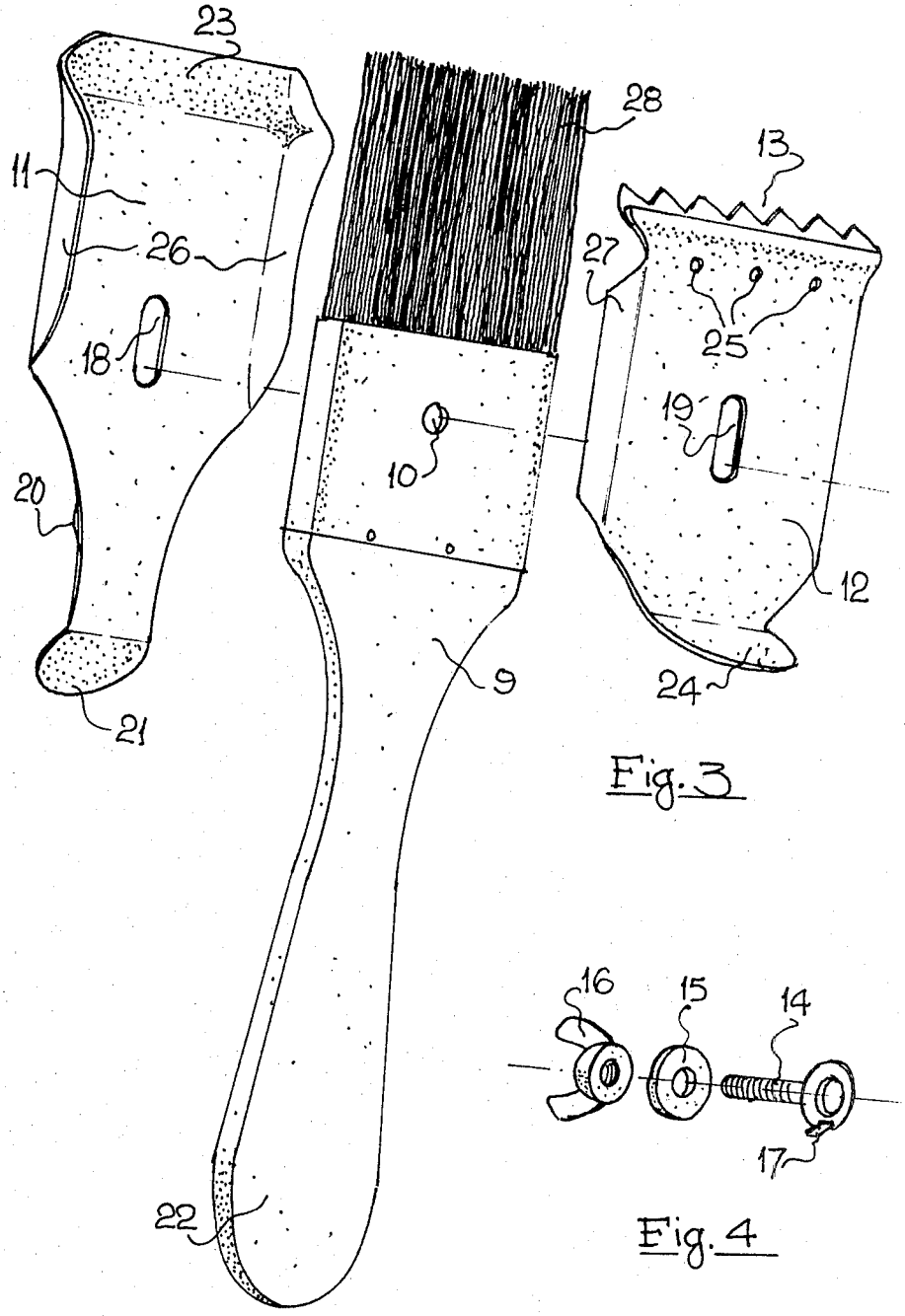
Figure 6:
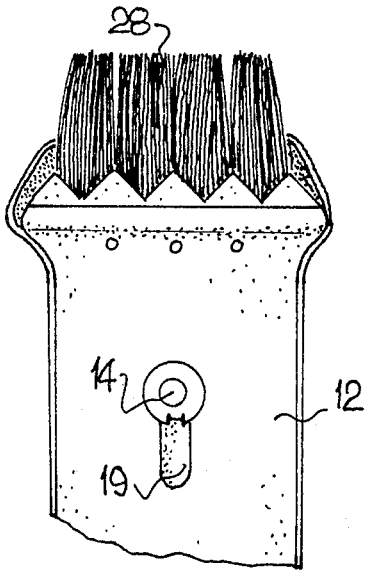
Figure 7:
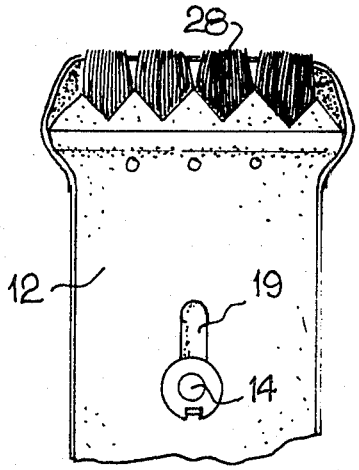
Figure 8:
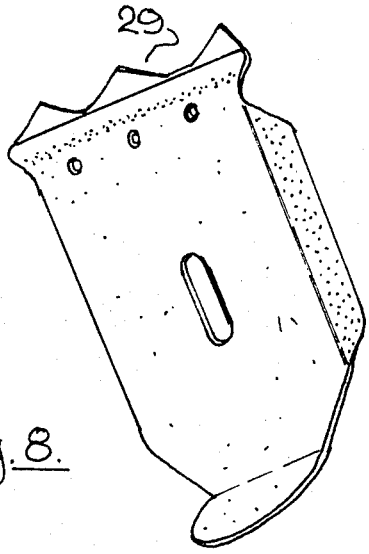

Certain embodiments of the invention defined in the preceding paragraph will now be described herein with reference to the accompanying drawings, in which similar references indicate corresponding parts, and in which:

FIG. 1 shows, in a general perspective view, the manner of application of the "cloth" in one prior art system, FIG. 2 shows, in perspective view, a tool used in another prior art system, FIG. 3 is a perspective exploded view of two components of a tool constructed in accordance with the invention, in juxtaposition with a known kind of brush having a hole therein, FIG. 4 is a perspective exploded view of a threaded bolt and wing-nut for fastening together the apparatus of FIG. 3, FIG. 5 shows, in side elevation, the assembled tool with valances of said two components thereof overlapping, FIGS. 6 and 7 show, in plan view, how adjustment of the positions of said two components gives varying graining patterns and using, for example, a comb with five tines, and FIG. 8 shows, in perspective view, a modification of the invention using a comb with three such tines.

Upon referring to the drawings it will be seen that a graining brush 9 consists typically of a standard 380 mm bat paint brush (this being a flatter brush with somewhat less bristle content than the more conventional type of paint brush) which has been provided with a positioning hole 10 located so as to permit the ready assembly of a bristle-retaining slidable plate 11 and a bristle adjusting comb plate 12 shown here typically with seven teeth in its comb 13. Said plates are fastened about the brush 9 by means of the fastening means shown in FIG. 4 comprising the threaded bolt 14, the washer 15 and the wing-nut 16. It will be seen that the threaded bolt 14 possesses a detent or stop 17 outstanding from the head thereof so that when said bolt is passed through the slot 18 in the slidable plate 11 and then through hole 10 in brush 9, and then through slot 19 in comb plate 12 to be subsequently engaged by the washer 15 and the wing-nut 16, said detent 17 may be aligned suitably in the slot 18 to discourage subsequent rotation of the bolt 14 after the wing-nut 16 has been firmly rotated thereon to achieve the assembled condition best shown in FIG. 5.

The slidable plate 11 has a finger rest 20 and pull-back lever 21 disposed near the handle 22 of the brush 9, whereas the end of said slidable plate remote therefrom terminates in an inwardly turned lip 23. The comb plate 12 terminates rearwardly near the brush handle 22 in a finger grip 24, whereas the remote end of this plate inwardly from the comb 13 is provided with a plurality of drip holes such as 25. Both sheets may be formed from sheet metal.

In addition, the slidable plate 11 is provided with side cheeks 26 while the comb plate 12 is provided with similar side cheeks such as 27. The respective pairs of side cheeks fittingly envelop the bristles 28 of the brush 9, at least in part.

As best shown in FIG. 5, the lip 23 and the comb 13 constitute valances which are re-entrant so as to urge the bristles 28 into a controlled row of bundles.

Upon reference to FIGS. 6 and 7 it will be seen that the relative endwise displacement of the comb plate 12 and the slidable plate 11, which is effected by slackening off the wing-nut 16, permits varying arrangements of the bristle bundles and hence provides for varying graining patterns when said bristles are applied to a surface of furniture or the like, pre-coated in known manner with a suitable staining liquid. After a desired arrangement of the bundles has been achieved, the two plates may of course be temporarily re-locked in relation to each other by again tightening the wing-nut 14. Nevertheless the entire assembly can be simply demounted by completely removing said wing-nut, for cleaning or other purposes.

A further and coarser variation in graining patterns may be ensured simply by providing a range of combs having a different number of tines. For example, as shown in FIG. 8, an alternative coarser comb 29 having three such tines may be provided.

In a typical coarse graining process the slidable plate 11 is adjusted with respect to the comb plate 12 until the bristles 28 protrude approximately 3 to 5 mm beyond the lip 23. The comb plate is then moved up away from the handle 22 to its stop position inside said slidable plate. Various effects may then be obtained by an operator in dependence upon the angle at which the brush is held, and pleasing patterns of different kinds may be obtained by varying the pressure upon the brush while performing graining strokes. In the production of coarse grain effects it is preferably that the brush should be held at an angle of approximately 55° to 75° from a horizontal work surface. For fine graining this angle may vary between 55° and 65°. Natural discontinuities in the grain may be simulated by using a slight rocking pressure from side to side with the hand, while brushing. For fine grain the slidable plate and the comb plate are both moved back towards the brush handle to their rearmost position but, if desired, for experimental effects, the plates may be moved in any direction dictated by the limitations of slots 18 and 19 and by said fastening means. Certain special effects, such as that of a butt grain, may be obtained by using the brush in a sweeping motion, then momentarily pausing, and then recommencing that motion. Another added effect results from giving, at intervals, a light weaving action during the general brushing action, to produce such grains as those likely to be found in silky oak or similar timbers.

With very little practice or experiment an operator may thus achieve desired grain patterns with extraordinary ease, and with little mess or soiling. In this connection, the apparatus constructed in accordance with the invention eliminates any tendency towards clogging and saturating by the graining solution, which is a hazard when using the muslin or other cloth of FIG. 1 to create grain. If necessary, any excess liquid applied to a particular part of the work surface may be simply wiped away by means of a clean cloth.

The claims defining the invention are as follows.

I claim:

1. A graining tool comprising, in combination, a paint brush, a bristle-retaining slidable plate having an elongated slot therein and a finger rest and pull-back lever thereon, a slidable comb plate terminating in a comb and having a second elongated slot therein together with a finger grip, said comb plate being adapted to slide within said bristle-retaining plate via fittingly co-acting respective margins of said plates, the latter being adapted to encompass the bristles of said brush in registering juxtaposition therewith, and lockably removable fastening means being adapted to engage said slots via a preformed hole in the bristle-supporting base of said brush, whereby said comb adjustably separates said brush bristles into discrete bunches to an extent determined by the relative endwise adjustment of said plates responsive to relative displacement of said finger grip with respect to said finger rest and pull-back lever, thereby permitting the application of said brush to a pre-stained surface to cause said bunches to impart a wood grain simulating pattern to said surface as said brush is manipulated across said surface with a pattern-describing motion.

2. A graining tool as claimed in claim 1, wherein said fastening means comprises a threaded bolt and a wing-nut applicable thereto, the head of said bolt being co-extensive with a detent adapted to engage the slot in said slidable plate to prevent the rotation of said head with respect to said slot when said wing-nut is tightened with respect to said bolt to thereby clamp said plates about the bristles of said brush.

3. A graining tool as claimed in claim 2, wherein said bolt is slidable along said slots longitudinally upon slackening said wing-nut, to thereby permit relative displacement of said plates to vary the degree of bunching of said bristles by said comb.

4. A graining tool as claimed in claim 2 or claim 3, wherein said fastening means is removable entirely from said slots to permit dismantling of said tool.

5. A graining tool as claimed in any one of claims 1–3, wherein said slidable comb plate is one of a series of such plates each possessing a terminating comb thereon having a different number of comb teeth.

6. A graining tool as claimed in any one of claims 1–3, wherein said brush is a bat brush.

7. A graining tool as claimed in any one of claims 1–3, wherein said plates are fabricated from sheet metal.

* * * * *